US008850974B2

(12) United States Patent
Olschewski et al.

(10) Patent No.: US 8,850,974 B2
(45) Date of Patent: Oct. 7, 2014

(54) DEVICE AND A METHOD FOR INSTALLING AND ADJUSTING CARRIER DISCS AND NUMBERING UNITS OF A NUMBERING MACHINE

(75) Inventors: Günter Olschewski, Naunhof (DE); Jürgen Schams, Bucha (DE)

(73) Assignee: KBA-Notasys SA, Lausanne (CH)

( * ) Notice: Subject to any disclaimer, the term of this patent is extended or adjusted under 35 U.S.C. 154(b) by 399 days.

(21) Appl. No.: 13/059,030

(22) PCT Filed: Aug. 4, 2009

(86) PCT No.: PCT/EP2009/005616
§ 371 (c)(1),
(2), (4) Date: Feb. 14, 2011

(87) PCT Pub. No.: WO2010/017905
PCT Pub. Date: Feb. 18, 2010

(65) Prior Publication Data

US 2011/0146507 A1 Jun. 23, 2011

(30) Foreign Application Priority Data

Aug. 14, 2008 (DE) ..... 10 2008 037 792

(51) Int. Cl.
*B41L 49/02* (2006.01)
*B41K 3/12* (2006.01)
*B41F 33/00* (2006.01)

(52) U.S. Cl.
CPC ..... *B41K 3/126* (2013.01); *B41P 2233/13* (2013.01); *B41F 33/009* (2013.01)
USPC ..... 101/87; 101/72; 101/77; 101/84

(58) Field of Classification Search
USPC ..... 101/87
See application file for complete search history.

(56) References Cited

U.S. PATENT DOCUMENTS

| | | | | |
|---|---|---|---|---|
| 3,269,306 | A * | 8/1966 | Smilgys | 101/85 |
| 3,377,948 | A * | 4/1968 | Giori | 101/76 |
| 3,728,960 | A * | 4/1973 | Heath | 101/76 |

(Continued)

FOREIGN PATENT DOCUMENTS

| | | |
|---|---|---|
| DE | 1005978 | 4/1957 |
| DE | 3618488 | 7/1987 |
| FR | 2857902 | 1/2005 |

*Primary Examiner* — Jill Culler
(74) *Attorney, Agent, or Firm* — Seager, Tufte & Wickhem LLC

(57) ABSTRACT

The invention relates to a device and to a method for providing and adjusting a numbering machine with which value papers or sheets of value papers are printed with an individual piece of information, particularly a serial number. The numbering machine comprises carrier discs and numbering units on said carrier discs, wherein a plurality of numbering units are fixed on a carrier disc and a plurality of said carrier discs are fixed on a shaft, and the shaft is driven by at least one drive element with at least one rotary encoder. According to the invention, a position device provides the target position of the carrier discs and the associated numbering units on the associated carrier discs. Such a position device is preferably a light generating device with a light beam, a mechanical stop collar, or a camera with a monitor with a reticle. A light generating device hereby is preferably a laser or illumination means with focusing lenses that indicate the target position with a light spot on the carrier disc or the numbering unit.

8 Claims, 4 Drawing Sheets

(56) References Cited

U.S. PATENT DOCUMENTS 4,398,459 A * 8/1983 Guenther et al. ..... 101/76
4,495,582 A 1/1985 Dessert et al.
4,512,256 A 4/1985 Schriber et al.
4,843,959 A * 7/1989 Rendell ..... 101/72
5,517,911 A * 5/1996 Rendell et al. ..... 101/72

* cited by examiner

DEVICE AND A METHOD FOR INSTALLING AND ADJUSTING CARRIER DISCS AND NUMBERING UNITS OF A NUMBERING MACHINE

TECHNICAL FIELD

The invention relates to a device and a method for setting and adjusting a numbering machine by way of which papers of value or sheets of papers of value are printed with an individual information item, in particular a serial number. Such numbering machine comprises, inter alia, carrier disks and numbering units mounted on said carrier disks, a plurality of numbering units being mounted on a carrier disk and a plurality of said carrier disks being mounted on a shaft, and the shaft being driven by at least one drive element with at least one rotary encoder.

BACKGROUND OF THE INVENTION

Each of said numbering units prints the individual information item on the paper of value or the sheet of papers of value, the individual information item being changed in the following printing operation. Thus, for example, the value of the serial number, during printing of individual papers of value, is incremented or decremented by one after the printing operation.

The setting of the position of the individual carrier disks and numbering units of a numbering machine is performed manually in the prior art. Here, the individual carrier disks on the shaft and the individual numbering units of each carrier disk are positioned roughly according to a predefined layout and locked. By way of the numbering machine which is set roughly in this way, a first sample or a first sample sheet is printed, the prints of the individual numbering units are measured and the correction values to achieve the stipulated target positions are calculated. Then, the individual positions of the carrier disks on the shaft and of the individual numbering units of each carrier disk are corrected by hand and a sample sheet is printed again. This operation is repeated until the positions of the prints of the individual numbering units on the paper of value or the sheet of papers of value lie within the margins of error of the target positions.

However, this is particularly disadvantageous in that this operation requires a considerable amount of time and manpower. For instance, it can take up to fourteen hours until the numbering units of a numbering machine are completely adjusted. During this time, the numbering machine is not available for printing papers of value or sheets of papers of value.

SUMMARY OF THE INVENTION

An aim of the invention is therefore to provide a device and a method for installing and adjusting a numbering machine, by way of which the disadvantages of the prior art are eliminated.

This aim is achieved thanks to the features of the independent claims. Further embodiments of the invention form the subject matter of the dependent claims.

According to the invention, a positioning device designates the target position of the carrier disks and of the respective numbering units on the corresponding carrier disks.

In a particularly preferred embodiment, the target positions are established as follows.

The paper of a sheet to be printed, before it undergoes any printing operations, is usually rectangular. In contrast, after the printed sheet has been printed almost completely, and before printing of the printed sheet with the individual information item in the numbering machine is carried out, the printed sheet is deformed or distorted in trapezoidal manner, wherein the front edge of the printed sheet is shorter or, in rare cases, longer than its trailing edge. In addition, the trapezoidal deformation usually does not take place uniformly on both side edges, but rather to a more pronounced extent towards one side edge than towards the other side edge. For example, a printed sheet can be deformed to a more pronounced extent towards its left side edge than towards its right side edge. In addition, this trapezoidal deformation can change depending on the job, for example can be different in the case of a job with 32 multiple copies per sheet than in the case of a job with 50 multiple copies per sheet. Therefore, the actual positions of the individual papers of value or multiple copies on the printed sheet are first of all determined in the horizontal and vertical directions, that is to say in the x and y directions, via a measuring device, using an almost completely printed sheet which is still to be printed with the individual information items. Such data are designated as actual data.

Subsequently, correction data are determined for actual and optimum positioning of the printed sheet in the numbering machine. This impacts, in particular, on the two front guides, against which the printed sheet bears with its front edge at the input of the numbering machine, and on the side guide, against which the printed sheet bears with one of its side edges. Thus, the non-uniform trapezoidal deformation can be averaged by displacing one front guide towards the front or towards the rear, in such a way that the difference between the front edge with respect to the trailing edge of the sheet is divided equally laterally over the numbering units for each individual banknote.

Then, a mathematical combination of the actual data with the correction data is carried out to produce a data set for input to the control device of the rotary encoder and of the positioning device. The following applies here:

- if a front guide has to be displaced to the rear, the correction data of the front guide are subtracted from the actual data,
- if, in contrast, a front guide has to be displaced to the front, the correction data of the front guide and the actual data are added,
- if the printed sheet is deformed in such a way that it becomes wider to the rear, the correction data of the side guide and the actual data are added and the result is divided by two.

The input data in the vertical direction here are optimum positioning data. The input data in the horizontal direction are averaged data relating to the maximum lateral difference between the side guide or side contact edge of the printed sheet and the lateral position of the respective row in the gripper of the paper sheet and the lower edge of the sheet. In the horizontal direction, the determination takes place for each row of multiple copies on a sheet of papers of value or printed sheet, it being assumed by definition that the middle row or rows do not exhibit any deformation.

The positioning device is preferably a light generating device for the generation of a light beam, for example a laser or a light source with focusing lenses, which laser or light source designates the target position with a light spot on the carrier disk or on the numbering unit. As an alternative, the positioning device can also be configured as a mechanical stop or as a camera with a monitor having a reticle.

The positioning device here is preferably guided parallel to the shaft of the numbering machine, said positioning device being moved by a drive element to the individual target positions of each carrier disk.

Banknotes are usually printed with two or more serial numbers. Thus, for example, one serial number is oriented horizontally and another serial number is oriented vertically, it being however understood that any other desired orientation is also possible, for example diagonal orientation. For this purpose, the numbering machine has two or more shafts, which are usually arranged parallel above one another. According to the example mentioned, the numbering units are oriented horizontally on one shaft and vertically on the other shaft. In this case, the positioning device can also additionally be guided vertically with respect to the shafts of the numbering machine and can be moved with respect to the respective shafts by a further drive element. It is particularly advantageous here that a plurality of shafts be set and adjusted by way of one positioning device, without this requiring a change of the shafts.

As soon as the carrier disk, respectively the numbering unit is mounted in its respective target position, the positioning device preferably outputs a visual and/or acoustic signal for the operating staff. This is the indication for the operating staff that the carrier disk can then be locked on the shaft or the numbering unit can be locked on the carrier disk and the next carrier disk or the next numbering unit can be positioned.

In addition, the rotary encoder indicates the individual target positions of the numbering units on the respective carrier disks. The drive element here rotates the shaft until the target position of the numbering units is reached and then the drive element switches off, the carrier disk remaining at its target position.

The method for setting a target position of carrier disks and of numbering units on said carrier disks of a numbering machine proceeds here as follows:

a) first of all, the positioning device designates a target position of the first carrier disk and of the first numbering unit on the first carrier disk. The positioning device therefore at the same time designates the target position of the first carrier disk and of the first numbering unit on the first carrier disk as x and y values. If the positioning device is, for example, a laser, the laser beam designates both target positions at the same time. In the case of a laser with a fixed focal length which produces a dot sharply at a predefined distance, the target position of the first numbering unit on the first carrier disk is thereby designated, said target position at the same time also representing the target position of the first carrier disk.

b) Then, the first numbering unit is placed onto the first carrier disk and is displaced with the first carrier disk along the shaft until the first carrier disk has reached the target position and locks on the shaft.

c) At the same time as the carrier disk and therefore at the same time as step b), the first numbering unit is displaced on the first carrier disk until the first numbering unit has reached its target position and locks on the first carrier disk. Steps b) and c) therefore take place at the same time, the carrier disk and the numbering unit approaching the target position in a recursive process.

d) Subsequently, the rotary encoder indicates the target position of the second numbering unit on the first carrier disk, whereupon the drive element rotates the shaft until the first carrier disk has reached the target position of the second numbering unit.

e) The operation according to steps c) and d) is carried out or repeated for the second and every further numbering unit of the first carrier disk.

f) When all the numbering units are attached on the first carrier disk, the operation according to steps a) to e) is carried out or repeated for all further carrier disks and corresponding numbering units.

The designation first carrier disk, respectively first numbering unit, here can be assigned to any desired carrier disk and any desired numbering unit, respectively, and is not necessarily restricted to an outer carrier disk and an outer numbering unit, respectively. Likewise, the second or every further carrier disk and the second or every further numbering unit do not necessarily have to be the carrier disk and numbering unit, respectively, which lie closest geometrically. Rather, the positioning device can use, as the next carrier disk and as the next numbering unit, any desired carrier disk and any desired numbering unit, respectively, which have not yet been adjusted.

According to a further embodiment, use can be made of a positioning device which does not have to be set to the different distances between the carrier disk and numbering unit. For this purpose, for example, a laser can be used, the focal length of which can be set to different distances. The positioning device can therefore designate in each case the target position of the carrier disks and of the numbering units. A common indication for the carrier disk and numbering unit is not required. The method for setting a target position of carrier disks and of numbering units on said carrier disks proceeds here as follows:

a) First of all, the positioning device designates a target position of the first carrier disk.

b) Then, the first carrier disk is displaced on the shaft until the first carrier disk has reached the target position and locks on the shaft.

c1) The positioning device then designates a target position of the first numbering unit, and c2) the first numbering unit is placed onto the first carrier disk and is displaced on the first carrier disk until the first numbering unit has reached the target position and locks on the first carrier disk.

d) Subsequently, the rotary encoder indicates the target position of the second numbering unit on the first carrier disk, whereupon the drive element rotates the shaft until the first carrier disk has reached the target position of the second numbering unit.

e) The operation according to steps c) to d) is carried out or repeated for the second and every further numbering unit of the first carrier disk.

f) When all the numbering units are attached on the first carrier disk, the operation according to steps a) to e) is carried out or repeated for all further carrier disks and corresponding numbering units.

The advantage of the invention is that the setting and adjusting of a numbering machine is automated at least partially, as a result of which the amount of time and manpower required can be reduced considerably. Thus, thanks to the device according to the invention and the method according to the invention it takes, for example, only two hours until a numbering machine is set and adjusted completely. As a result, it is advantageously possible to reset and to adjust a numbering machine between different print jobs with only a small amount of time being lost.

As an alternative, it is also possible to carry out the installation and adjusting of carrier disks and of numbering units of a single shaft on a separate numbering machine which is available exclusively for setting and adjusting purposes of this type. In this case, after setting and adjusting have taken place, the shaft is removed from the separate numbering machine and is installed in the actual numbering machine. This has the particular advantage that a changeover between different print jobs can be carried out virtually without a downtime of the actual numbering machine.

The advantages of the invention will be explained using the following embodiments or examples and the complementary figures. The individual features described and the exemplary embodiments described in the following text are inventive in their own right, but are also inventive in combination. The examples represent preferred embodiments, but the invention is not to be restricted to these in any way.

Furthermore, the illustrations in the figures are highly schematic, for the sake of improved comprehension, and do not reflect the real practical conditions. In particular, the proportions shown in the figures do not correspond to the conditions present in reality and serve exclusively to improve the clearness. Likewise, the embodiments described in the following examples are reduced to the essential core information for the sake of improved comprehension. Substantially more complex patterns or images can be used in a practical implementation.

DETAILED DESCRIPTION OF EMBODIMENTS OF THE INVENTION

Figure 1:
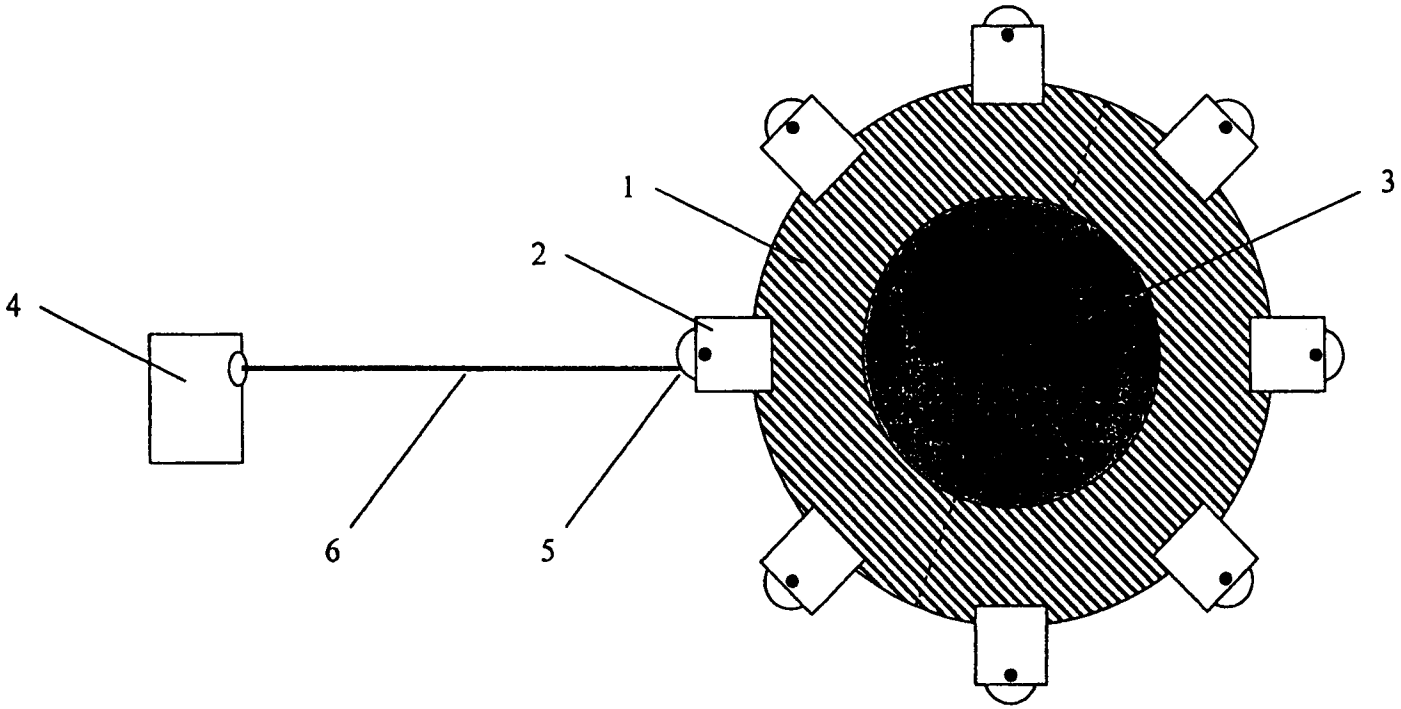
FIG. 1 diagrammatically shows, in a side view, a positioning device according to the invention in the form of a laser which designates the target position of a numbering unit on a carrier disk.
Figure 2:
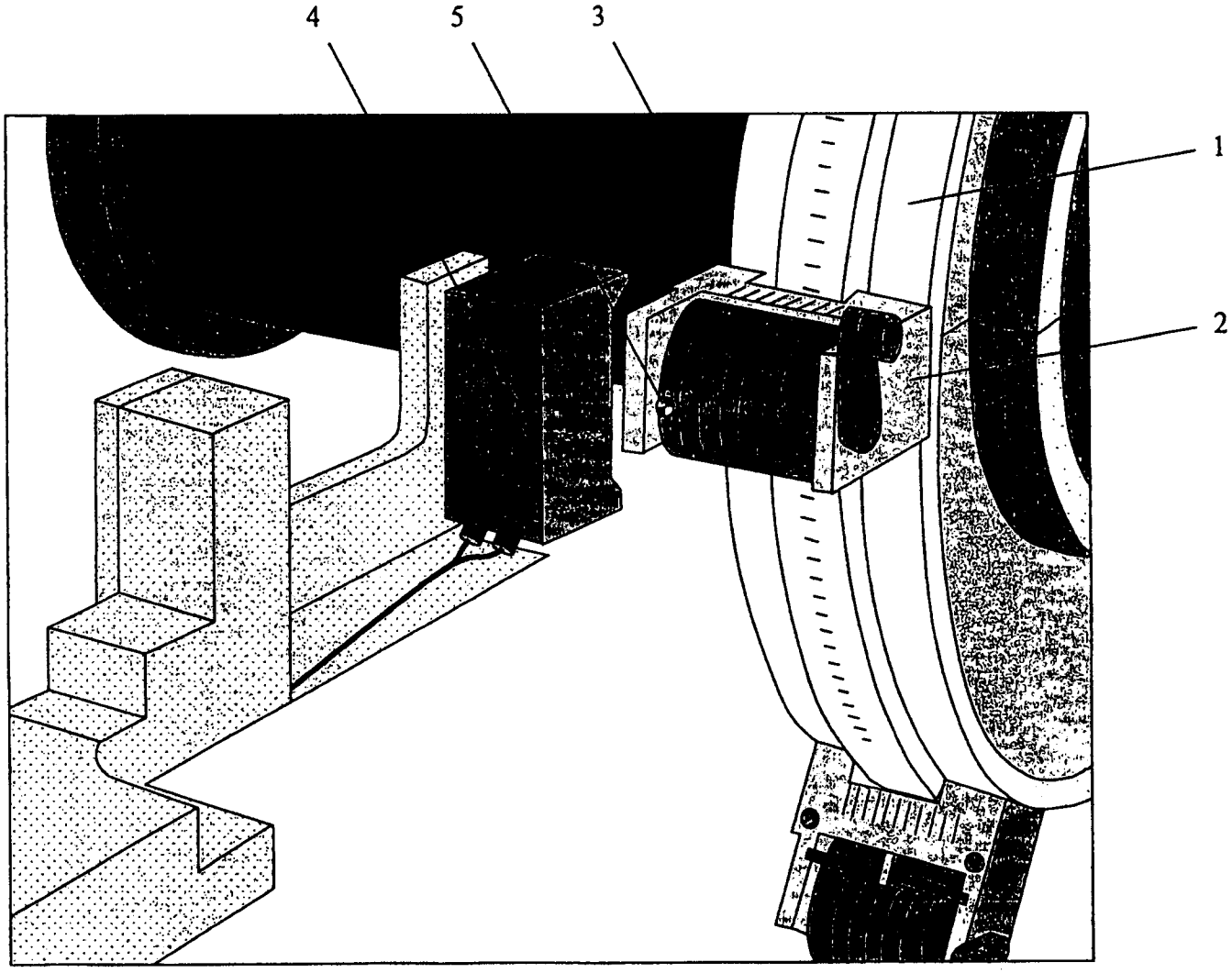
FIG. 2 shows, in perspective view, a picture of the positioning device according to the invention in accordance with FIG. 1, FIG. 3 diagrammatically shows, in plan view, a numbering unit with the associated target position, and FIG. 4 diagrammatically shows in plan view, in FIGS. 4*a* to 4*d*, the operation during the installation and adjusting of a carrier disk and two numbering units on said carrier disk.

FIG. 1 and FIG. 2 show a positioning device according to the invention in the form of a laser 4 which designates the target position of a numbering unit 2 on a carrier disk 1, the carrier disk being mounted on a shaft 3. A laser beam 6 here designates the target position 5 of the numbering unit 2 as a light spot on the numbering unit 2, for example, according to FIG. 3, the position of the left-hand number wheel of the numbering unit. The reference point here is the lower edge of the number "0".

FIG. 4 shows the operation during the installation and adjusting of a carrier disk 1 and of two numbering units on said carrier disk 1 with the use of a laser with a fixed focal length, which laser cannot be set to different distances between the laser and the measured object. According to FIG. 4*a*, the laser designates the target position 5 of the first carrier disk 1 and therefore also, at the same time, of the first numbering unit 2. The operating staff then places the numbering unit 2 onto the carrier disk 1, releases the locking of the carrier disk 1 on the shaft 3 and pushes the carrier disk 1 in the direction of the target position 5. As soon as the target position 5 according to FIG. 4*b* is reached approximately, the numbering unit 2 is displaced approximately in the direction of the target position 5. Then, the carrier disk 1 is displaced again a little in the direction of the target position 5, subsequently the numbering unit 2 is displaced again, etc. This recursive process is repeated until both the numbering unit 2 and the carrier disk 1 have reached the target position.

As soon as the carrier disk 1 and the numbering unit 2 have reached the target position 5, the positioning device outputs a visual and/or acoustic signal. In addition to the visual positioning of the light spot for the target position 5 on the carrier disk 1, a visual and/or acoustic signal therefore informs the operating staff that the target position of the carrier disk 1 and of the numbering unit 2 is reached. The operating staff locks the carrier disk 1, which is then situated in its target position, and confirms the operation, for example by pressing a corresponding button of an operating element.

Figure 3:
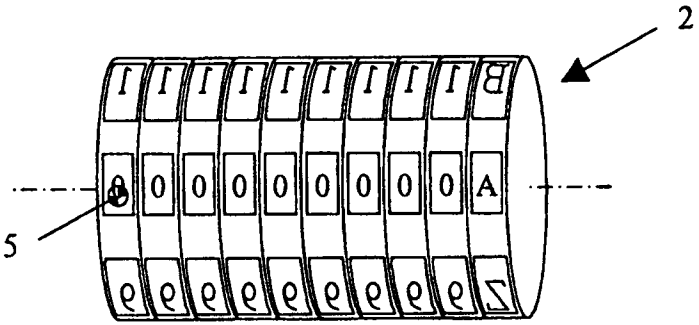
Figure 4B:
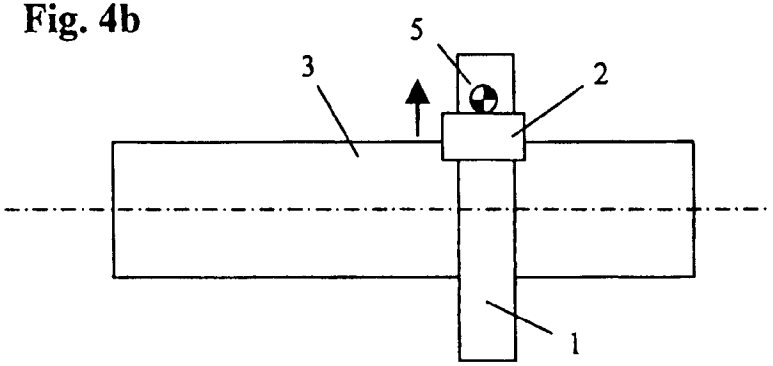
Figure 4A:
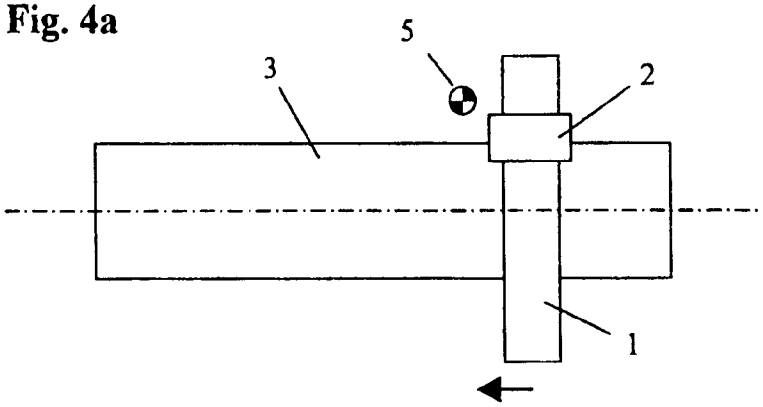
Figure 4D:
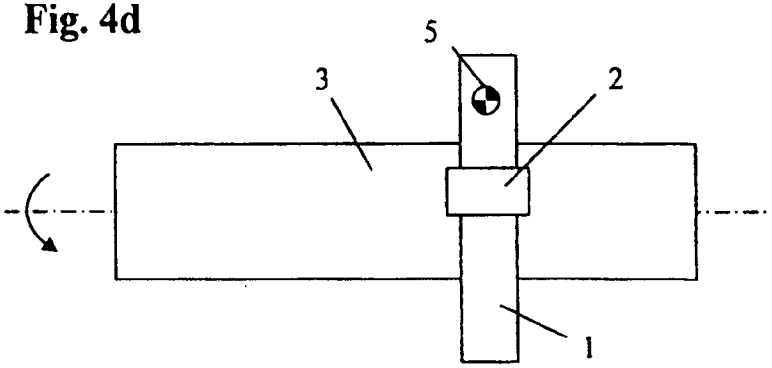
Figure 4C:
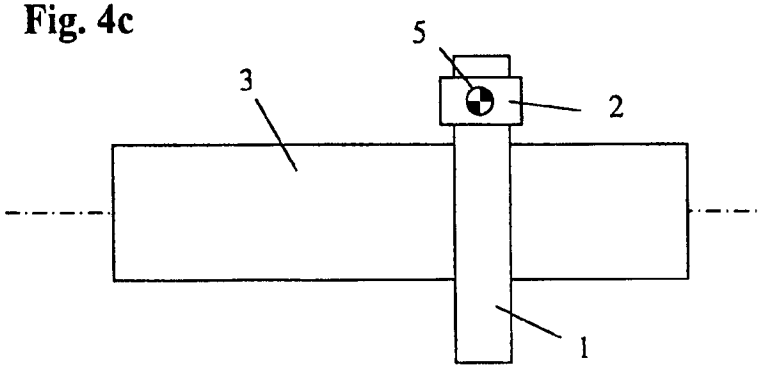

Subsequently, the operating staff places the numbering unit 2 onto the carrier disk 1 and displaces it until the reference point, the lower edge of the left-hand number "0" in the example of FIG. 3, coincides with the target position. In addition, in this case also, the positioning device outputs a visual and/or acoustic signal. The operating staff locks the numbering unit 2 on the carrier disk 1, which numbering unit 2 is then situated in its target position, and confirms the operation, for example by pressing a corresponding button of an operating element.

In order to position the following numbering unit, a drive device rotates the shaft 3 until the rotary encoder of the drive device gives a signal that the target position of the numbering unit is reached. The rotary encoder stops the drive device, with the result that the shaft 3 and therefore the carrier disk come to rest at the target position of the numbering unit. The operating staff places the numbering unit onto the carrier disk 1 and repeats the operation in a corresponding manner as for the adjustment of the preceding numbering unit.

The operation is repeated correspondingly for all further numbering units and carrier disks until the last numbering unit is put onto the last carrier disk.

The positioning device here is guided parallel to the shaft of the numbering machine, such positioning device being moved by a drive element with respect to the individual target positions of each carrier disk.

Finally, for control purposes, a paper of value or a sheet of papers of value can be printed with the numbering machine which has been set and adjusted, and the deviation of the printed individual information item with the stipulated position is checked. The preferred positional accuracy of the respective numbering units here is 0.1 mm, that is to say the printed individual information items should deviate from the respective stipulated position by no more than 0.1 mm.

The invention claimed is:

1. A device for setting and adjusting a numbering machine for printing papers of value or sheets of papers of value with an individual information item, in particular a serial number, the numbering machine comprising carrier disks and numbering units on said carrier disks, wherein a plurality of numbering units are mounted on a carrier disk and a plurality of said carrier disks are mounted on at least one shaft, and wherein the at least one shaft is driven by at least a first drive element with at least one rotary encoder, characterized in that a positioning device designates in each case a target position of the carrier disks along the shaft and of the respective numbering units on the corresponding carrier disks, wherein said positioning device is guided parallel to the shaft of the numbering machine, and a second drive element moves the positioning device to the individual target positions of each carrier disk.

2. The device as claimed in claim 1, characterized in that the positioning device is a mechanical stop or a camera with a monitor having a reticle.

3. The device as claimed in claim 1, characterized in that the positioning device is a laser or a light source with focusing lenses, which laser or light source designates the target position with a light spot on the carrier disk or on the numbering unit.

4. The device as claimed in claim 1, characterized in that, when at least two shafts are used above one another, the positioning device is guided vertically with respect to the shafts of the numbering machine, and a further drive element moves the positioning device with respect to the respective shafts.

5. The device as claimed in claim 1, characterized in that the positioning device outputs a visual and/or acoustic signal when the carrier disk or the numbering unit has reached its respective target position.

6. The device as claimed in claim 1, characterized in that the rotary encoder indicates in addition the individual target positions of the numbering units on the respective carrier disks, and the first drive element rotates the shaft until the target position of the numbering units is reached.

7. A method for setting and adjusting a numbering machine for printing papers of value or sheets of papers of value with an individual information item, in particular a serial number, the numbering machine comprising carrier disks and numbering units on said carrier disks, wherein a plurality of numbering units are mounted on a carrier disk and a plurality of said carrier disks are mounted on a shaft, and wherein the shaft is driven by at least one drive element with at least one rotary encoder, characterized in that a) a positioning device guided parallel to the shaft and driven by a second drive element designates a target position of the first carrier disk along the shaft and of the first numbering unit on the first carrier disk, b) the first numbering unit is placed onto the first carrier disk and is displaced with the first carrier disk on the shaft until the first carrier disk has reached the target position, whereupon the first carrier disk is locked on the shaft, and at the same time c) the first numbering unit is displaced on the first carrier disk until the first numbering unit has reached its target position, whereupon the first numbering unit is locked on the first carrier disk, and then d) the rotary encoder indicates the target position of the second numbering unit on the first carrier disk and the drive element rotates the shaft until the first carrier disk has reached the target position of the second numbering unit, and then e) the operation according to steps c) and d) is carried out or repeated for the second and every further numbering unit of the first carrier disk, and then, f) when all the numbering units are attached on the first carrier disk, the operation according to steps a) to e) is carried out or repeated for all further carrier disks and corresponding numbering units.

8. A method for setting and adjusting a numbering machine for printing papers of value or sheets of papers of value with an individual information item, in particular a serial number, the numbering machine comprising carrier disks and numbering units on said carrier disks, wherein a plurality of numbering units are mounted on a carrier disk and a plurality of said carrier disks are mounted on a shaft, and wherein the shaft is driven by at least one drive element with at least one rotary encoder, characterized in that a) a positioning device guided parallel to the shaft and driven by a second drive element designates a target position of the first carrier disk along the shaft, b) the first carrier disk is displaced on the shaft until the first carrier disk has reached the target position, whereupon the first carrier disk is locked on the shaft, and then c1) the positioning device designates a target position of the first numbering unit on the first carrier disk, c2) the first numbering unit is placed onto the first carrier disk and is displaced on the first carrier disk until the first numbering unit has reached the target position, whereupon the first numbering unit is locked on the first carrier disk, and then d) the rotary encoder indicates the target position of the second numbering unit on the first carrier disk and the drive element rotates the shaft until the first carrier disk has reached the target position of the second numbering unit, and then e) the operation according to steps c1) to d) is carried out or repeated for the second and every further numbering unit of the first carrier disk, and then, f) when all the numbering units are attached on the first carrier disk, the operation according to steps a) to e) is carried out or repeated for all further carrier disks and corresponding numbering units.

* * * * *